United States Patent [19]

Nolan

[11] Patent Number: 4,819,678

[45] Date of Patent: Apr. 11, 1989

[54] PORTABLE CLEANER

[76] Inventor: James F. Nolan, 30 Millbank St., Rochester, N.Y. 14619

[21] Appl. No.: 200,938

[22] Filed: Jun. 1, 1988

[51] Int. Cl.[4] ..... B08B 3/02

[52] U.S. Cl. ..... 134/186; 134/195

[58] Field of Search ..... 134/59, 104, 111, 115 R, 134/173, 174, 186, 191, 195, 198

[56] References Cited

U.S. PATENT DOCUMENTS

| | | | |
|---|---|---|---|
| 2,254,824 | 9/1941 | Large | 134/104 X |
| 2,438,654 | 3/1948 | Albertson | 134/195 X |
| 3,343,555 | 9/1967 | Kasner | 134/191 X |
| 4,029,115 | 6/1977 | Wheeler | 134/111 |
| 4,052,227 | 10/1977 | Delo et al. | 134/111 X |
| 4,226,548 | 10/1980 | Reith | 134/111 X |
| 4,464,256 | 8/1984 | Plourde | 134/111 X |
| 4,506,114 | 11/1977 | Boutillette | 134/104 |
| 4,637,413 | 1/1987 | Llewellyn et al. | 134/111 |

*Primary Examiner*—Philip R. Coe

*Attorney, Agent, or Firm*—James J. Ralabate

[57] ABSTRACT

A cleaning unit for cleaning any type parts used domestically or commerically. The unit has a main containing vessel. The containing vessel is divided into upper and lower chambers by a dividing shelf extending across slightly less than the interior of the vessel. A gap is provided thereby for seepage of liquid from the upper to the lower compartment when in use. A small D.C. pump is used to pump liquid from the lower to upper chamber when used.

13 Claims, 1 Drawing Sheet

Fig. 1
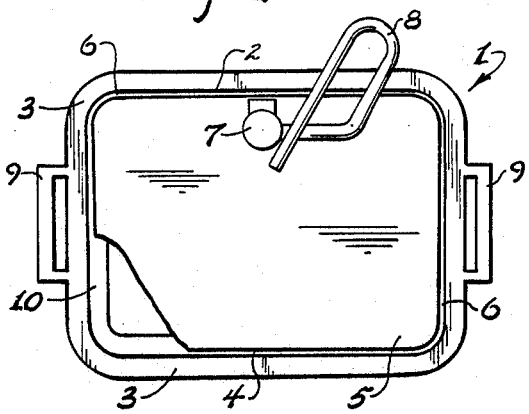
Fig. 2
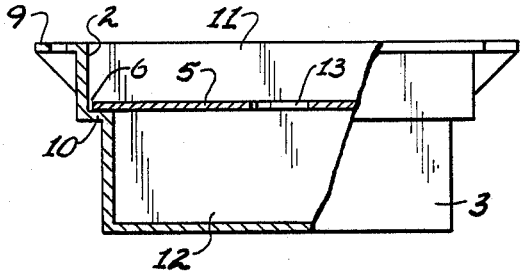
Fig. 3
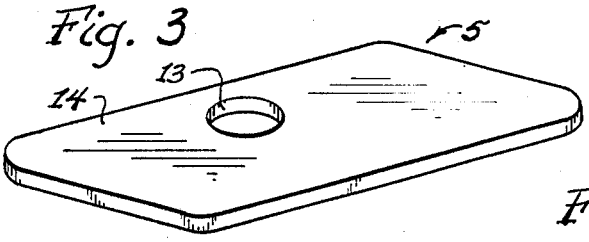
Fig. 4
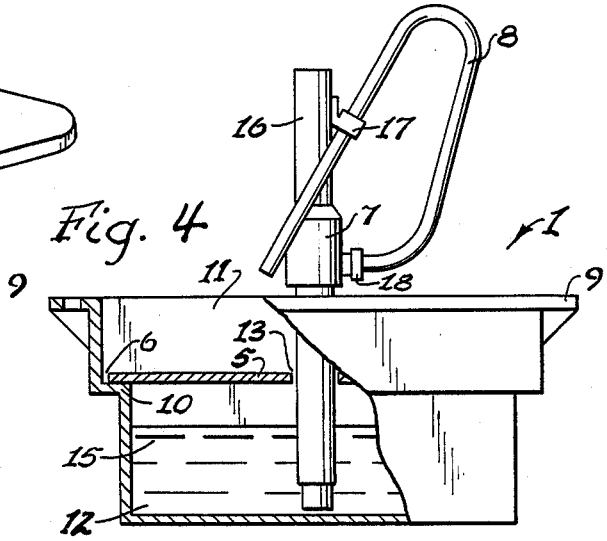
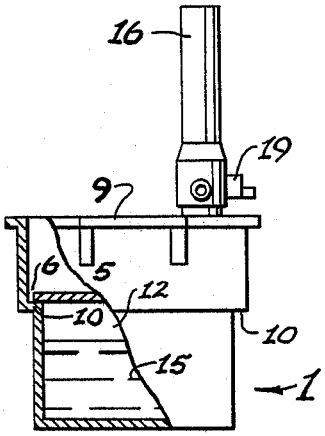
Fig. 5
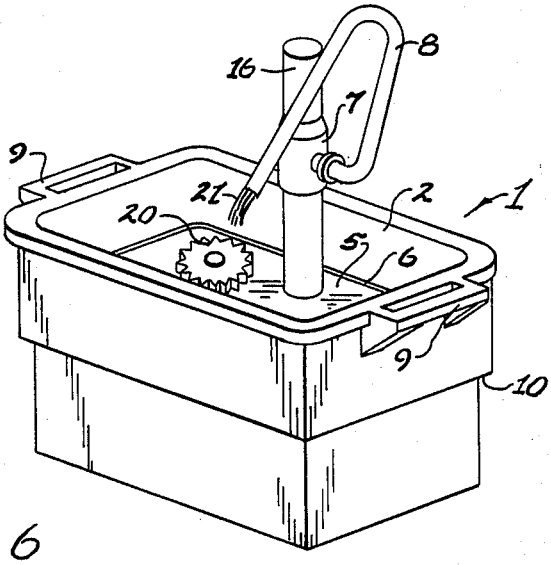
Fig. 6

PORTABLE CLEANER

This invention relates to a novel degreasing apparatus and, more particularly, to a light-weight portable cleaner.

BACKGROUND OF THE INVENTION

It is known to utilize various cleaning apparatuses to clean machine or any mechanical parts and components such as metal or plastic automotive, domestic or commercial items. During machine use, these parts accumulate dust, dirt and grease and require periodic cleaning. Most of these cleaning apparatuses are stationary and the parts to be cleaned need to be brought to the cleaning apparatus. Further, most of these cleaning devices are expensive to purchase, expensive to maintain and are of a complicated construction. Also, parts of these cleaning apparatuses need frequent replacement such as filters, cartridges and the like. Since most prior art cleaners or cleaning apparatuses hold from about 5–30 gallons of cleaning fluid at one time, the fluid could become contaminated with the first use. Upon continued use, the filters do little to prevent contamination, since the filters become clogged with grease and provide little protection against cleaning fluid contamination. Since these complex and stationary cleaning devices are expensive, some users have been leasing and others buying them at a substantially high cost.

Some of the known prior art cleaning devices are disclosed in U.S. Pat. Nos. 4,029,115; 4,052,227; 4,464,256 and 4,637,413. In U.S. Pat. No. 4,029,115 (Wheeler) a stationary, relatively complex parts washer is disclosed. Wheeler uses a rather complicated air pressure-solvent feed system that requires the use of an air compressor, an air regulator, and air lines and fittings. The maintenance costs for Wheeler's type device could be high since it comprises a comparatively expensive filter, expensive drain system, and is constructed of metal. Since metal devices of this type are very heavy and difficult to move, it is logical that they be made stationary and designed for use in one location. Because of the nature of Wheeler's device, it requires one foot and one hand to operate it, thus becoming somewhat limiting. Also, with devices of this type, the large solvent tank is difficult to clean after use. The filter of Wheeler must be replaced fairly frequently, and the correct specific air compressors, air regulators, and air lines and fittings are required.

In U.S. Pat. No. 4,052,227 (Delo) a parts washer is disclosed constructed of metal and relatively heavy and difficult to move. Since the structure is heavy and since it has a relatively large solvent capacity, Delo's device is a stationary one. It utilizes a large electric pump (110 v) which is submerged in the solvent holding tank. It also uses an expensive filter system that could require frequent replacement and upkeep. In addition, the drain system is relatively complicated and overall the entire structure is complicated. As with Wheeler's device, the solvent tank cleaning is comparatively difficult, and contamination of large volumes of solvent occurs with few uses.

In U.S. Pat. No. 4,464,256 (Plourde) a cleaning device is disclosed that is complex and requires relatively high maintenance costs. Again, the solvent tank is difficult to clean, since the device would require removal of several components in the cleaning operation. Like the other above described prior art patents, Plourde's device is stationary, heavy and involves relatively high maintenance costs. All of the systems that use a filter system require frequent replacement to minimize contamination of the cleaning solution or solvent. Because the solvent capacity is so large, contamination of solvent becomes expensive in devices of this type. Also the use of large pumps require access to 110 V outlets which by its very nature limits the portability of such devices.

In U.S. Pat. No. 4,637,413 (Llewellyn) a degreasing apparatus is defined which is on wheels to permit movement from one place to another. Llewellyn's device requires an air or electric motor to drive its pumping system. While Llewellyn's device is movable, it is comparatively heavy being constructed of metal. Since Llewellyn's device is very low, it becomes somewhat awkward to use, requiring the user to kneel or sit on the floor. The device is too heavy to conveniently lift onto a higher surface for easier access. In addition, the tank of this apparatus is not easy to clean because removal of other components are required. Since the structure is constructed so low to the ground, any maintenance including cleaning becomes awkward and somewhat difficult.

SUMMARY OF THE INVENTION

It is therefore an object of this invention to provide a cleaning device devoid of the above noted disadvantages.

Another object is to provide a relatively inexpensive, portable cleaning device that can be brought to the location of the parts to be cleaned.

A further object of this invention is to provide a simply constructed, light weight cleaning device that has a self-contained D.C. pump.

Still a further object of this invention is to provide a simple, compact cleaning device with a comparatively small solvent capacity to minimize large volume contamination.

Also, it is an object of this invention to provide a cleaning device that is easy to disassemble and store.

A yet further object of this invention is to provide a cleaning apparatus that does not require the use of a filter and thus provides much lower maintenance costs.

Still yet another object is to provide a cleaning device easy to clean, easy to maintain, easy to move, yet effective in use.

These and other objects are accomplished, generally speaking, by a novel device comprising a vessel having a ridge or abutment extending around the inner periphery of the vessel. Resting on this abutment is a dividing shelf which divides the vessel in half and upon which parts to be cleaned can be positioned. The shelf can be supported by additional brackets or supports together with this abutment. The shelf has a gap at at least one point along its periphery. It is from this gap that cleaning fluid will drain to the bottom of the vessel. Below said dividing shelf is a chamber for containing the cleaning fluid to be used. The shelf contains an aperture conduit or tube through which a pump fits snuggly and is supported thereby. The pump is preferred to be a 1.5 volt D.C. pump that uses 2 D-size batteries. It requires no 110 volt or any external power source. The pump supplies approximately 1–3 gallons per minute in continuous operation, and is constructed as follows:

The pump starts out as an Aladdin Battery Powered Kerosene Pump Model S4044 1.5 volts (2 D-size batteries) available from Aladdin International Corporation, 1260 Heil Quaker Blvd., LaVergne, Tenn. 37086. This pump has a pumping capacity of 2.3 gallons per minute, and is a centrifugal type pump using 2 D-size alkaline batteries. The pump has been modified as follows:

(A) The inlet pipe has been shortened 9" to reduce the overall length from 23½" to 14½". The shorter fluid lift the pump now has will improve flow performance, pump life and battery life.

(B) A plastic clip has been added to the on/off switch to allow the pump to operate as original with the push on-release off method or with a switch on continuous operation-switch off.

(C) A plastic hose mounting clip has been added which the solvent hose can be slid in or out of. With the hose in the clip, you have hands-free operation. With the hose out of the clip, you can direct the flow of solvent. The length of the pump is slightly smaller than the diagonal dimensions of the interior of the vessel. This is required since the pump is placed diagonally in said vessel when not in use and when being moved from place to place. The length of the pump must also be such that it fits down into the lower chamber containing the liquid and extends upward beyond the upper portion of the vessel. The pump contains at its upper portion an activation means and an outlet for connection to a flexible hose. The liquid is pumped from the liquid chamber up through the pump and out the flexible hose to contact the parts to be cleaned. With the cover removed, the pump is slid into the mounting tube which automatically positions the pump for use. The nozzle hose is slipped into the hose mount clip on the side of the pump. The nozzle hose is flexible for hand held operation or, when positioned in the mounting clip, gives hands-free operation. The on/off switch can be depressed and hand-held for short time operation or the clip lever can be set for continuous hands-free pump operation. The cleaning fluid drains back into the liquid chamber or the bottom holding part of the tank. The shelf/pump support tube unit can be removed by lifting out with pump in place. The support tube is used to pull pump out or rotate it to direct the cleaning fluid at a desired location. In use one would slide the pump out of the pump support tube, set the pump in the tray and snap the cover on, and the unit is ready to move to the next job or location.

The cleaner unit of this invention was conceived, designed and built to provide an economical, safe and portable tool to clean dirty and greasy parts at the location of the parts. With a self-contained battery powered pump mounted in a two section polyethylene cleaning vessel or tank, this lightweight, truly portable parts cleaner goes with the user and other tools to the job. Uses for the cleaner are as varied and numerous as the uses of wrenches, pliers and screwdrivers. Uses include work done on cars, motorcycles, boats, snowmobiles, ATV's, RV's, trailers, tools, lawnmowers, snowblowers, tractors, farm equipment, appliances, manufacturing equipment, machine shop equipment and construction equipment.

An example of the preferred embodiment is as follows:

Size (in use): 15¾" long, 10" wide, 16" high, (in transport or storage): 16" long, 10½" wide, 7" high with cover on.

Tank: 3 gallon size with dividing shelf, holding the cleaning fluid below and parts to be cleaned on the shelf. In use, the cleaner holds up to 1 gallon of cleaning fluid.

Pump: 1.5 volt plastic construction D.C. pump uses 2 D-size batteries. Uses no 110 V or any external power source. The pump will supply approximately 1½ gallons per minute in continuous operation Weight: Approximately 3 pounds total unit (empty).

Cleaning Fluid: It is preferred to use any non-volatile, non-flammable, non-toxic cleaning fluid. Liquid detergents are also used. However, any suitable cleaning fluid or solution may be used. No filter is required in the present cleaner.

Since the cleaning liquid capacity is so small, and since the contaminants are so easy to draw off from the bottom of the containing vessel, a filter is not needed. Since the filters perviously used are expensive, require frequent changing, and because they easily clog up, they were not substantially effective, and avoidance of their use is highly desirable. To accommodate portability, the liquid capacity is kept comparatively small (1 gallon preferred); thus, on a worse case bases, only a small amount of liquid could be contaminated. This is in contrast to prior art systems where large capacity liquid systems need filters and need expensive, complex purification means.

The dividing shelf is a shelf that fits approximately halfway down the containing or cleaning vessel and forms two chambers, an upper chamber for the parts to be cleaned, and a lower chamber to house the liquid cleaner. The dividing shelf rests on a ridge or projection extending outwardly from the inner portion of the vessel. Intermediate brackets or supports for support of the shelf may also be used if suitable. The periphery of the dividing shelf is slightly smaller than the periphery of the interior of the vessel. In lieu of a smaller periphery, the shelf can have at least one position along its periphery to accomodate drainage. This is critical to the present invention, since seepage of the liquid takes place along the edges of the dividing shelf. This seepage takes place at a rate slightly slower than the output rate of the liquid through the hose. Because of this rate differential, there is always a small amount of liquid cleaner remaining on the upper surface of the dividing shelf for brushing on the parts to be cleaned. It is therefore highly preferred that the dividing shelf be solid; however, if desirable, the shelf could be a screen, wire mesh or have a perforated surface. The preferred solid construction for the dividing shelf also prevents splashing or spilling of the liquid when the cleaning unit is moved from one location to another.

In the present invention herein disclosed, contaminants generally settle at the bottom of the container or vessel, and can easily be removed by any known means such as a stop-cock drain, suction, or the like. The liquid or solvent cleaner then can continuously be used. In any event, because of the limited capacity for the liquid cleaner, there is not much of the liquid to become contaminated.

The cleaning vessel of this invention has handles for allowing easy portability of the unit.

The pump contains a liquid outlet for attachment to a flexible hose that is used to direct a steady stream of cleaning liquid to the parts to be cleaned. On the outer portion of the pump is a hose mount for attaching the hose when not in use, or when use of both hands is required. The cleaning unit of this invention can be used with any suitable type liquid cleaner such as: "Globe rite 45", no catalog number, 10%-20% by volume with water, 15 gallon container, made by Texo Corporation, 2801 Highland Avenue, Ohio 45412; "Emersol - combustible" Part #70333, 5 gallon, made by Emerson Fuel, 545 Lyell Avenue, Rochester, N.Y.; "2-22 Blue", Cat. #Part #57128, 1 gallon, or "Petroleum Solvolene", Cat. #006-0025, 5 gallon, both made by Castle Chemical, 418 St. Paul Street, Rochester, N.Y.; and "6-27 Solvent 5- Combustible", no catalog number, 5 gallon pail, or "Lustre Safety Solvent, Non-combustible", no catalog number, 5 gallon pail, both made by Davis Holland Oil Corporation, 200 Anderson Avenue, Rochester, N.Y. 14607.

The components, including the vessel, of the unit of this invention should be constructed from fiberglass, plastics or other suitable materials. Some of the suitable plastics are polyvinylchloride, polyethylene, polycarbonates, polyurethanes, polystyrene and the like.

BRIEF DESCRIPTION OF THE DRAWING

FIG. 1 is a top plan view of the cleaning unit of this invention.

FIG. 2 is a side plan view of the dividing shelf and supporting ridge in the vessel.

FIG. 3 is a top perspective view of the dividing shelf detached from the vessel.

FIG. 4 is a front plan view of the cleaning unit of this invention.

FIG. 5 is a side plan view of the cleaning unit of this invention.

FIG. 6 is a top perspective of the cleaning unit of this invention.

DESCRIPTION OF THE DRAWING AND THE PREFERRED EMBODIMENT

In FIG. 1, the cleaning unit 1 of this invention is shown from a top view. In its preferred form the interior wall periphery 2 of the vessel 3 is slightly larger than the periphery 4 of dividing shelf 5, to form thereby a slight gap or opening 6. In lieu of a smaller periphery a small gap at at least one part of the periphery may be used for drainage. It is through this gap 6 that liquid cleaner seeps down from the surface of dividing shelf 5 to the bottom portion of vessel 3. This is an important feature of the present invention. A pump 7 fits into and through dividing shelf 5, and is supported thereon. In liquid flow connection with pump 7 is a flexible hose 8 that is used to squirt cleaner liquid onto parts to be cleaned. On the side portion of vessel 3 are handles 9 used to carry cleaning unit 1 from one location to another.

In FIG. 2, a fragmented view of front of vessel 3 is illustrated wherein dividing shelf 5 is shown forming a gap 6 with the interior wall 2 of vessel 3. Dividing shelf 5 rests on ridge or abutment 10 formed or projecting inwardly from interior wall 2. The slight gap 6 permits seepage of cleaning liquid from parts chamber 11 to liquid chamber 12 at a relatively slow rate, thus permitting liquid to remain in chamber 11 for brushing parts or using to further clean parts to be cleaned. By "slight" or "slightly" is meant from about 0.001 to 0.0100 inches small; however any suitable dimension gap may be used. As stated earlier, the exit rate of liquid out of flexible tube 8 is slightly greater than the seepage rate of the liquid through gap 6. The thickness of dividing shelf 5 should be such that it easily supports metal parts to be cleaned, and it should be relatively chemically inert to the cleaning liquid to be used. In approximately the center rear portion of dividing shelf 5 is an aperture 13 into which pump 7 fits and is supported. This aperture can be located in any portion of shelf 5, however, locating it centrally permits easy access to parts located on all portions of shelf 5. FIG. 3 shows the shelf 5 with aperture 13 for receiving pump 7 when in use. In lieu of just an aperture 13 or conduit, a mounting tube can be used if desired. A mounting tube would provide additional stability for the pump. A mounting tube also provides easy rotating or moving of the pump when directing the fluid flow to the desired location. Parts to be cleaned are positioned on upper surface 14 of shelf 5.

In FIG. 4, a plan view of the cleaning unit 1 when assembled for use is shown Pump 7 extends through the conduit or aperture 13 (as shown in FIG. 3) in shelf 5 and its lower portion submerged in cleaning liquid 15. Cleaning liquid 15 is housed in liquid chamber 12 from where it is easily drained or discarded. To fill liquid chamber 12, shelf 5 is merely removed and liquid poured into chamber 12. Parts to be cleaned are placed in parts chamber 11 on top surface 14 of shelf 5. Pump 7 is activated by pushing on/off switch and liquid 15 will flow from chamber 12 through pump 7, through and out of flexible hose 8. Pump 7 is preferred to be a 1.5 volt D.C. pump with 1.5 gallons per minute capacity. The pump used in this invention is a modified Aladdin pump which was supplied by Aladdin International Corp. It is run by two or more D-size flashlight batteries that are easy to install and remove from battery compartment 16. Battery compartment 16 is constructed as is a conventional flashlight battery section. On the outer surface of the pump 7 is a hose mount 17 adapted to receive and hold flexible hose 8. Also on the outer lower surface of pump 7 is pump outlet 18 to which flexible hose 8 is connected in a liquid tight manner.

In FIG. 5, a side view of cleaning unit 1 is shown with the hose 8 disconnected for clarity. Pump outlet 18 is shown at the lower portion of pump handle just below the battery compartment 16. A pump on/off switch 19 is conveniently located anywhere on the outer portion of pump 7. To activate pump 7, one merely pushes the switch on and liquid will be pumped by pump 7 up to and through hose 8.

In FIG. 6, a perspective view of cleaning unit 1 is shown. A part 20 (a sprocket shown but any part can be cleaned) is placed on surface 15 of shelf 5. A cleaning liquid stream 21 exits hose 8 and contacts part 20 to clean part 20 of grease and contaminants. The liquid is then accumulated on surface 14 and slowly seeps down through gap 6 back into liquid chamber 12. If desired, some type of screen could be put in gap 6 to remove large contaminants, but is preferred for simplicity and ease of operation to have gap 6 unobstructed and allow free flow of liquid therethrough.

The preferred and optimumly preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. A portable cleaning unit comprising a containing vessel, a dividing shelf, and a pump, said containing vessel comprising a ridge projecting inwardly from interior wall of said vessel, said dividing shelf resting on and supported by said ridge, said dividing shelf forming above its upper surface a parts chamber and below its lower surface a liquid chamber which houses a liquid cleaner, said dividing shelf having an aperture through which said pump fits and is supported thereby, said dividing shelf having a peripheral portion with dimensions slightly shorter than a peripheral portion of said interior wall of said vessel to form a gap thereby.

2. The cleaning unit of claim 1 wherein said pump is slightly shorter than the interior diagonal dimension of said parts chamber.

3. The cleaning unit of claim 1 wherein said pump has a liquid output slightly greater than flow of said liquid through said gap from said parts chamber to said liquid chamber.

4. The cleaning unit of claim 1 wherein said pump has attached in liquid flow connection a flexible hose.

5. The cleaning unit of claim 1 wherein said pump is powered by conventional batteries and is constructed of a material substantially chemically inert to said liquid cleaner.

6. The cleaning unit of claim 1 where all parts and components are substantially chemically inert to said liquid cleaner.

7. The cleaning unit of claim 1 wherein said pump contains a hose mount for holding or supporting a hose in position.

8. A cleaning unit comprising a containing vessel, a dividing shelf, and a pump, said containing vessel having an internal ridge extending at least partially horizontally around the inner periphery of said vessel, said dividing shelf resting on said ridge and forming thereby above said shelf a parts chamber and below said shelf a liquid chamber, said liquid chamber adapted to hold a liquid cleaner, said length and width of said shelf being slightly smaller than the same dimensions of said inner periphery of said vessel forming thereby a slight gap between said inner periphery and the terminal portions of said dividing shelf, said shelf comprising an opening through which said pump fits and extends above and below said shelf, said pump containing a battery compartment and adapted to transfer liquid from said liquid chamber to said parts chamber.

9. The cleaning unit of claim 8 wherein said pump has a liquid output slightly greater than flow of said liquid through said gap from said parts chamber to said liquid chamber.

10. The cleaning unit of claim 8 wherein said pump has attached in liquid flow connection a flexible hose.

11. The cleaning unit of claim 8 wherein said pump is powered by conventional batteries and is constructed of a material substantially chemically inert to said liquid cleaner.

12. The cleaning unit of claim 8 where all parts and components are substantially chemically inert to said liquid cleaner.

13. The cleaning unit of claim 8 wherein said pump contains a hose mount for holding or supporting a hose in position.

* * * * *